United States Patent [19]

Simmons

[11] Patent Number: 4,682,425

[45] Date of Patent: Jul. 28, 1987

[54] ADAPTERS FOR GOLF SHOES

[76] Inventor: Ronald G. Simmons, Rte. 8, Box 224, Russellville, Ala. 35653

[21] Appl. No.: 880,283

[22] Filed: Jun. 30, 1986

Related U.S. Application Data

[63] Continuation-in-part of Ser. No. 824,451, Jan. 31, 1986, abandoned.

[51] Int. Cl.[4] ..... A43B 13/40; A43B 13/38; A43B 5/00

[52] U.S. Cl. ..... 36/44; 36/43; 36/127; 128/585

[58] Field of Search ..... 36/43, 44, 127, 71; 128/584, 585; 12/146 M

[56] References Cited

U.S. PATENT DOCUMENTS

| | | | |
|---|---|---|---|
| 1,516,425 | 11/1924 | Dvilnsky | 12/146 M |
| 1,588,011 | 6/1926 | Campbell | 36/44 |
| 1,958,097 | 5/1934 | Shaw | 36/43 |
| 2,216,630 | 10/1940 | Sabel et al. | 128/584 |
| 2,237,946 | 4/1941 | Minor | 128/584 |
| 2,847,769 | 8/1958 | Schlesinger | 36/127 |
| 4,149,324 | 4/1979 | Lesser et al. | 36/127 |
| 4,161,829 | 7/1979 | Wayser | 36/127 |

FOREIGN PATENT DOCUMENTS

| | | | |
|---|---|---|---|
| 644815 | 10/1950 | United Kingdom | 36/8.5 |

*Primary Examiner*—Werner H. Schroeder
*Assistant Examiner*—Steven N. Meyers
*Attorney, Agent, or Firm*—Macdonald J. Wiggins

[57] ABSTRACT

Adapters for insertion into golf shoes are provided to cause the golfer to automatically assume a proper stance and to properly shift the weight from the rear foot to the front foot during a swing. The adapters comprise a pair of insoles, each having a leather insole of uniform thickness and a resilient insole portion attached to the leather insole and covering a portion along the outer edge of the leather insole. The resilient portion produces a thickened area adjacent the ball of the foot and over the heel area along the outer edge of the leather insole.

6 Claims, 8 Drawing Figures

FIG. 6
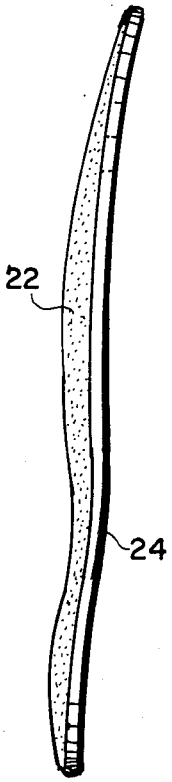
FIG. 5
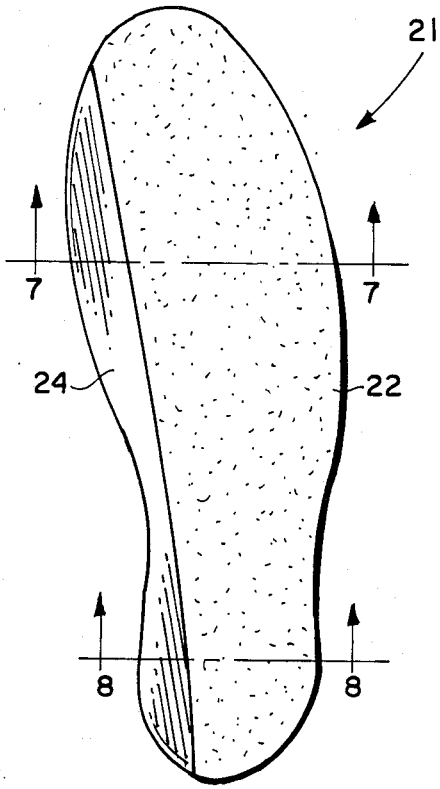
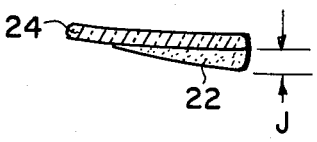
FIG. 8
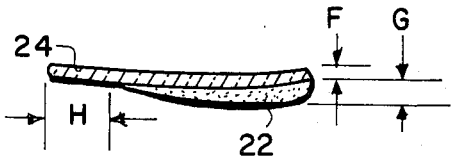
FIG. 7

ADAPTERS FOR GOLF SHOES

This application is a continuation-in-part of co-pending application Ser. No. 824,451 filed Jan. 31, 1986, abandoned and includes matter in common with Ser. No. 880,284 entitled "Improved Golf Shoes" filed simultaneously with the present application.

BACKGROUND OF THE INVENTION

1. Field of the Invention

The present invention relates to the adaptation of golf shoes to improve the stance and balance of the golfer, and more particularly to a construction of golf shoes and insoles which prevents an improper shifting of weight of the golfer during a golf swing.

2. Description of the Prior Art

It has long been recognized that the ideal golf swing is a somewhat unnatural movement for the skeletal and muscular structure of human beings. Therefore, it is necessary for a golfer to train his muscles to move in exactly the right manner to obtain a proper swing which will cause the ball to be driven along a straight, intended path. A common problem is the tendency for the golfer's weight to shift to the toe areas during a swing as the weight shifts from the rear foot to the front foot. When a golfer departs from the proper swing, generally due to such improper shifts of weight, a hook, a slice, or other undesirable path of the ball will result.

Even when a golfer has perfected his swing and recognizes the motion and necessity for balance, attention to these details during a swing will frequently distract him from his concentration on the game. Conversely, concentrating on the game will often result in failure to pay attention to the details of balance and swing. Therefore, there is a long felt need for an aid for a golfer which will automatically cause him to maintain the correct stance during an entire swing such that he may put his entire attention and concentration on the game. Thus, the golfer would not have the distraction of attention to the physical actions in making the swing.

This problem has been recognized in the prior art and there have been a number of attempts to assist the golfer in this area. For example, Schlesinger, in U.S. Pat. Nos. 2,847,769 and 2,959,874 describes shoes which are claimed to assist the golfer in maintaining a proper stance. These patents assume that the weight is to be back toward the heels and therefore teach shoes which slope downwardly to the heel region and are in an inward downwardly convergent relationship. This causes the entire weight to be transposed back through the heel region. However, most golfing authorities consider that only about 40% of the golfers weight should be on the heel and 60% on the ball of the foot area. Therefore, it is believed that the Schlesinger devices do not provide the optimum result. O'Brien, in U.S. Pat. Nos. 3,218,734; 4,081,918; and 4,118,034, teaches various types of wedges which are temporarily attached to a shoe in the instep area or forward slightly in the sole area. He teaches the use of this device only on the rear foot. Such devices have the disadvantage that they must be removed while walking and result in considerable distraction to the player. Furthermore, these devices would not produce the proper heel and sole weight distribution discussed above. French Pat. No. 1,141,593 to Carrier shows a pair of golf shoes having what appears to be a uniform wedge running the entire length of the shoes with the left shoe having a thicker wedge than the right shoe. Again, this arrangement would not produce the desired weight distribution.

It is apparent that the prior art has not solved the problem since none of these prior art patents appear to have achieved commercial success. I have researched the available golfing equipment and find none of these devices in general use.

SUMMARY OF THE INVENTION

My invention is a modification of the sole and heel areas of conventional golf shoes. The outer edge of the heel on each shoe is thicker than the inner edges thereof, with the taper extending to essentially the centerline of the heel. The actual thickness at the outer edge of the heel can be selected in accordance with the physical characteristics of the user. However, I have found that a thickness of about $\frac{1}{4}''$ greater on the outer edge than on the inner edge tapering to a uniform thickness along the longitudinal axis of the heel works well with the average person.

The sole portion, forward of the instep of the shoe, also includes a thick area along the outer edge of the sole with about $\frac{1}{4}''$ increase in thickness adjacent the ball of the foot and tapering to a uniform thickness at the toe and at the instep. Similarly, the increased thickness portion of the sole tapers to a uniform thickness along the longitudinal axis of the sole.

When the golfer wearing the shoes of my invention addresses the ball in the proper stance, the tapering of the sole and heel as described above advantageously produces the optimum distribution of weight between the sole and the heel. Further, the golfer's knees are forced slightly inward when they are bent as required by the proper stance. The shoes are therefore firmly planted and in uniform contact with the ground and, with the knees slightly bent and directed inwardly such that the golfer now has a firm solid stance. As the swing is performed, the weight will automatically shift from predominantly on the rear foot to predominantly on the front foot as is desired with no thought or effort on the part of the golfer. The modified shoes forces the balance of the golfer along the heel and the ball of the foot. During the swing, the shoes cause a rolling and pitching effect which keeps the weight off of the toes ensuring an accurate drive. The automatic control of movement of the golfer's weight permits him to therefore concentrate on the aim of the ball and the address of the ball ensuring a straight drive.

The amount of slope preferred in the shoes of my invention permits the golfer to walk naturally while at the same time shifting the weight slightly such that the inner muscles of the legs used during a golf swing obtain exercise and will thereby become strengthened over a period of time. This solves one of the problems for golfers; that of being above to improve the strength of the inner leg golf muscles. I have also determined experimentally that the maintenance of proper balance by the use of my invention enables a player to generate more power and energy transfer in both the backward and forward motion of the swing. The player contacts the ball more consistently and squarely, resulting in straighter and longer distances without any undue or extra effort.

Although it is desirable that the invention be applied to the shoes by building up the sole and heel as described above, it may also be practiced with any shoe by use of a novel inner sole. A pair of inner soles is shaped to fit the left and right shoes. Each sole includes a uniform thickness leather insole having a foam rubber portion cemented to the lower side thereof and tapered in the heel and sole area so as to produce the desired shift of weight of the user's outer edge of the sole portion and the heel portion of the foot. The inner soles are inserted into a standard golf shoe and serve to provide the advantages of my invention.

It is therefore a principal object of my invention to provide an adaptation of a golf shoe to have a thicker sole portion and a thicker heel portion along the outer edges of the sole and heel of the shoes for shifting the weight to a desired distribution and to thereby cause the golfer's knees to bend slightly inwardly when in the proper golf stance.

It is another object of my invention to provide modified golf shoes which will permit the golfer to maintain the proper stance during an entire golf swing and to cause the golfer's weight to automatically shift from the rear foot to the front foot during the swing.

It is yet another object of my invention to provide a sole area of a golf shoe in which the outer portion adjacent the ball of the foot is thickened and tapers to zero at the toe and at the instep and along a longitudinal centerline of the sole.

It is still another object of my invention to provide a golf shoe having a heel portion which is thicker along the outer edge thereof and tapers to zero along a longitudinal centerline of the heel.

It is yet another object of my invention to provide modified golf shoes which will permit the golfer to maintain the proper stance by forcing the balance automatically along the heel and ball of the foot and that causes a pitching and rolling effect during the shifting of weight of the golfer during a golf swing which keeps the weight off the right and left toes obviating directional errors.

These and other objects and advantages of my invention will become apparent from the following detailed description when read in conjunction with the drawings.

BRIEF DESCRIPTION OF THE DRAWINGS

FIG. 5 is a bottom view of an insertable inner sole for the left shoe of a pair of golf shoes;

FIG. 6 is a side view of the inner sole of FIG. 5;

FIG. 7 is a cross-sectional view through the plane 7—7 of FIG. 5; and FIG. 8 is a cross-sectional view through the plane 8—8 of FIG. 5.

DETAILED DESCRIPTION OF THE PREFERRED EMBODIMENT

Figure 1:
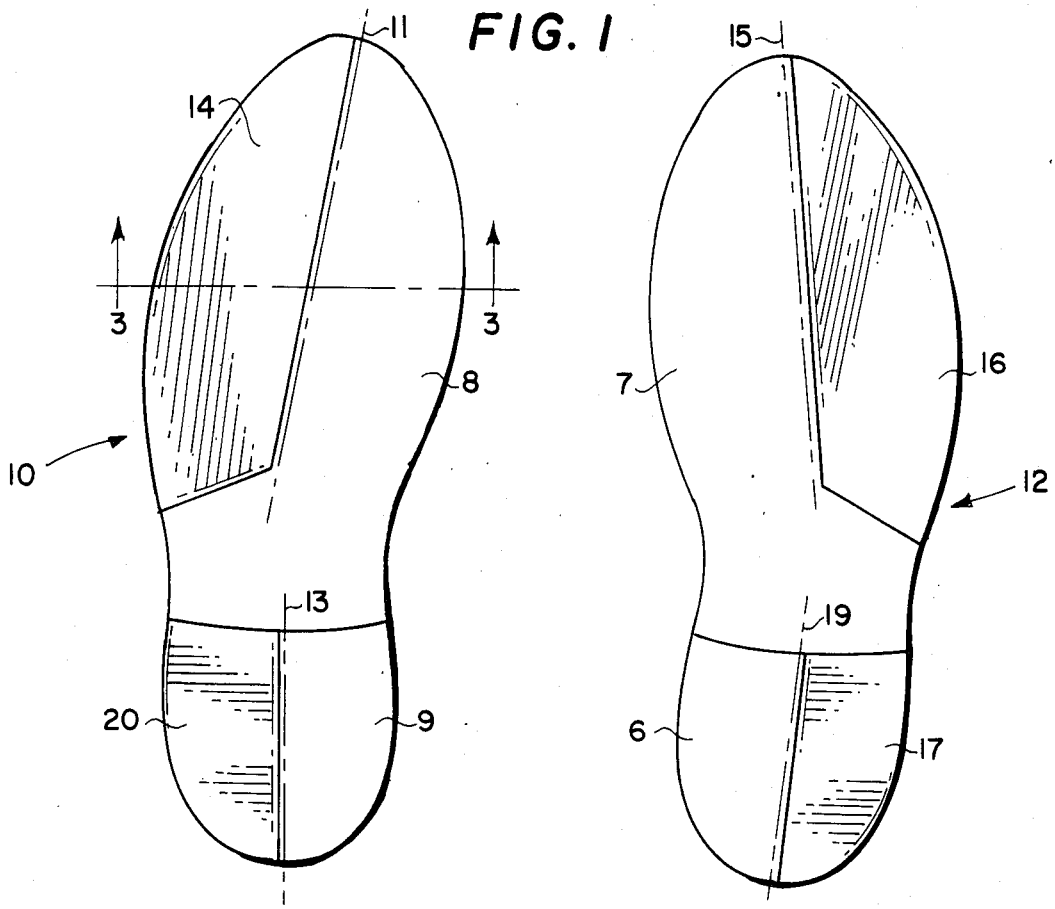
FIG. 1 shows the bottom of a pair of golf shoes having the outer edges of the sole portions and the heel portions built-up.
Figure 2:
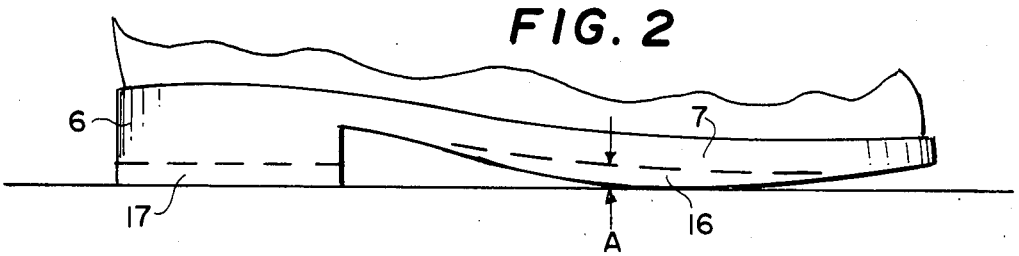
FIG. 2 is a side view of the left shoe of FIG. 1 showing the buildup of the sole portion and the heel portion along the outer edges thereof.

Referring to FIG. 1, the bottoms of a left shoe 12 and right shoe 10 are shown having the adaptation of the invention included therein. Referring to left shoe 12, sole 7 includes a thickened portion 16 which extends from the outer edge of sole 7 inward to essentially a longitudinal centerline 15. Thickened portion 16, as best seen in FIG. 2, is noted to be thickest adjacent the ball of the foot area of the shoe 12 and tapering to essentially zero at the toe and at the instep. The heel 6 has a thickened portion 17 which, as seen from FIG. 2, has an essentially uniform thickness over the length of the heel and tapers to zero along centerline 19 of heel 6.

Figure 3:
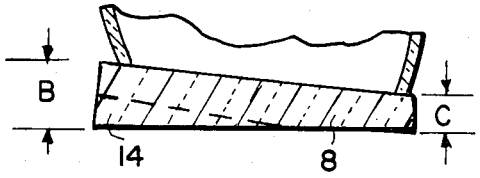
FIG. 3 is a cross-sectional view through the plane 3—3 of FIG. 1.

A cross-sectional view of the shoe 10 through section 3—3 is seen in FIG. 3. As will be noted, thickened sole portion 14 extends from the outer edge of sole 8 to the centerline 11 thereof. Dimension C shown in FIG. 3 may typically be about 7/16" for a golf shoe while the thickened portion B may be on the order of 11/16". I am not to be limited to these dimensions, and it will be obvious to those of ordinary skill in the art to adjust the thickness B in accordance with the physical characteristics of a particular golfer. However, as will be now noted, the increase in thickness along the outer edge of sole 8 may be on the order of ¼" or more.

Figure 4:
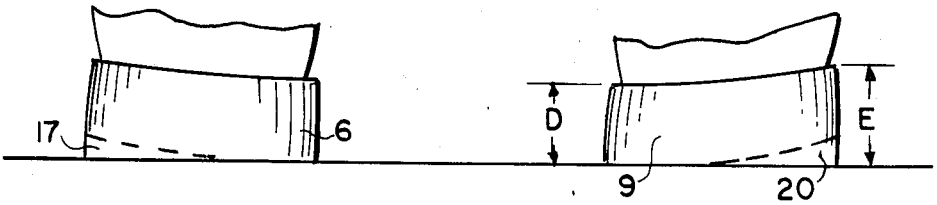
FIG. 4 is a rear view of the heel portions of the shoes of FIG. 1.

Turning now to FIG. 4, a rear view of heels 6 and 9 is shown indicating how the increased thickness portions 17 and 20 respectively cause a cant of the heels inward in accordance with my invention. A typical height D for heel 9 is 1" while the thickened outer dimension E may be on the order of 1¼", although it will be clear that these dimensions may be varied in accordance with the player.

As will now be recognized, I have provided shoes for golfers in which the outer edges of the heels and the soles are thicker than the inner edges by an amount sufficient to urge the golfer to take the proper stance and to hold it throughout a swing of the club, yet the cant of the shoes is not so great as to cause difficulty during normal walking. Although the illustrations have shown plain soles and heels, it is to be understood that golf spikes may be added to the soles as is customary.

An alternative embodiment of my invention is shown in FIGS. 5 through 8. For instances in which a golfer has favorite shoes or may wear different shoes from day to day, I provide a novel insole which will produce the same effect as the modified shoes described above. FIG. 5 illustrates an insole 20 formed to fit in a shoe and having a top portion 24 preferably formed from leather which may be on the order of 1/16" in thickness. A bottom portion 22 is preferably formed from polyurethane foam of a medium density. As seen in the side view of insole 21, foam portion 22 is formed to have a thick portion adjacent the ball of the foot region and a thickened portion beneath the heel with a zero thickness at the toe end and a thin portion at the endstep area. As shown in the cross-sectional view through plane 7—7 in FIG. 7, it may be noted that the foam portion 22 is thickest at the lateral edge of the insole having a thickness G of about ¼" while leather top portion 24 may have a dimension F of about 1/16". The foam rubber portion 22 extends from the lateral edge inward slightly beyond the centerline leaving a space H. Thus, when the golfer inserts insole 21 in the shoe and the golfer's weight is placed upon the upper portion 24, the compressibility of foam rubber portion 22 will result in essentially the lateral half of the insole having a greater thickness than the medial edge. I have found experimentally that low density foam is not satisfactory since a sufficient taper effect is not achieved while high density polyurethane foam will not yield and therefor permit the insole to form to the user's foot.

Although an insole for the left foot is shown in FIG. 5, a similar insole will be provided for the right foot such that the net result is essentially the same as for the special shoes previously described.

The heel area is shown in cross-sectional view through plane 8—8 of FIG. 5 in FIG. 8. The thickness J of the heel foam pad 22 may be on the order of $\frac{1}{4}''$ or slightly more to account for the compressibility of the polyurethane foam.

Thus, with the implementation shown in FIGS. 5 through 8, a golfer may utilize the benefits of my invention with any of his golf shoes. In numerous tests of my invention on the driving range and in actual play in tournaments, a number of golfers have been able to decrease their scores significantly and to achieve straight, long drives superior to their previous experiences. In many instances, users have reported an improved psychological effect in that they tend to forget their previous concern with proper stance and balance since these aspects seem to occur automatically using my invention. In such cases, the golfers find that they can concentrate on the other elements of the game with significantly improved results.

Although I have shown specific embodiments of my invention, it is to be understood that these are for exemplary purposes only and various modifications in design and thicknesses of material can be made by those of skill in the art without departing from the spirit and scope of my invention.

I claim:

1. An insole for golf shoes comprising:

a first insole portion formed to have heel and sole areas to fit within a golf shoe, said first insole portion having a uniform thickness; and a second resilient insole portion attached to said first insole portion having a non-uniform thickness in which said second insole portion increases the thickness of said insole along a lateral edge thereof, said thickness having a first maximum adjacent the ball of the foot area of said insole, tapering to zero thickness at the toe area, to a minimum thickness at an instep area, and to zero thickness along a line spaced apart from a medial edge of said insole, and a second maximum along the lateral edge of the heel area of said insole and tapering to zero thickness along said line and to said minimum thickness at said instep area.

2. The insole as recited in claim 1 in which said first insole portion is formed of leather.

3. The insole as recited in claim 1 in which said second insole portion is formed from a medium density foam rubber type material.

4. The insole as recited in claim 1 in which said first maximum thickness is about one-quarter inch.

5. The insole as recited in claim 1 in which said second maximum thickness is about $\frac{1}{4}$ inch.

6. A pair of insoles for insertion into a pair of golf shoes for causing the golfer to assume a correct stance, and to cause a shift in weight from the rear foot to the front foot during a golf swing comprising:

a pair of first insole portions each having a uniform thickness; and each of said first insole portions having attached to one surface thereof a second insole portion formed from a medium density foam rubber type material, said second insole portion having a non-uniform thickness which adds to the thickness of said first insole portion along a lateral edge thereof, said added thickness having a first maximum adjacent the ball of the foot area of said first insole portion, tapering to zero thickness at the toe area, to a minimum thickness at an instep area, and to zero thickness along a line spaced apart from a medial edge of said first insole portion, and a second maximum along the lateral edge of the heel area of said insole and tapering to zero thickness along said line and to said minimum thickness at said instep area.

* * * * *